US005746847A

United States Patent [19]

Tanaka et al.

[11] Patent Number: 5,746,847

[45] Date of Patent: May 5, 1998

[54] ALUMINUM ALLOY SHEET FOR EASY-OPEN CAN ENDS HAVING EXCELLENT CORROSION RESISTANCE AND AGE SOFTENING RESISTANCE AND ITS PRODUCTION PROCESS

[75] Inventors: Hiroki Tanaka, Osaka; Hiroyuki Mizutani; Midori Narita, both of Toyoake; Koichi Takada, Aichi, all of Japan

[73] Assignee: Sumitomo Light Metal Industries, Ltd., Tokyo, Japan

[21] Appl. No.: 651,413

[22] Filed: May 22, 1996

[30] Foreign Application Priority Data

Jul. 12, 1995 [JP] Japan ..... 7-199121

[51] Int. Cl.[6] ..... C22C 21/00

[52] U.S. Cl. ..... 148/692; 420/533; 420/547; 420/553; 148/698; 148/417

[58] Field of Search ..... 420/533, 547, 420/553; 148/698, 417, 692

[56] References Cited

U.S. PATENT DOCUMENTS 4,812,183 3/1989 Sanders, Jr. et al. ..... 420/533

*Primary Examiner*—David A. Simmons

*Assistant Examiner*—M. Alexandra Elve

*Attorney, Agent, or Firm*—Flynn, Thiel, Boutell & Tanis, P.C.

[57] ABSTRACT

An aluminum alloy containing magnesium (Mg) between 3.0 and 4.0 wt. %, manganese (Mn) between 0.5 and 1.0 wt. %, copper (Cu) between 0.2 and 0.6 wt. %, iron (Fe) between 0.05 and 0.4 wt. % and remaining obligatory trace elements, has an electrical conductivity after baking of 30 to 32% IACS, a yield strength of 320 MPa or more and a ratio of decrease in buckling strength after retort-treatment to that immediately after manufacturing the can end of less than 10%. This an aluminum alloy sheet for can ends has an excellent corrosion resistance, complete lack of stress corrosion cracking, or age softening resistance, maintains the a high buckling strength obtained subsequent to the manufacture of a can, even after retort treatment and storage at room temperature. The aluminum alloy sheet of this invention is particularly suitable for use as a can end for non-carbonated beverages and has the potential for even thinner aluminum alloy sheet formation.

4 Claims, 1 Drawing Sheet

ALUMINUM ALLOY SHEET FOR EASY-OPEN CAN ENDS HAVING EXCELLENT CORROSION RESISTANCE AND AGE SOFTENING RESISTANCE AND ITS PRODUCTION PROCESS

FIELD OF THE INVENTION

This invention relates to an aluminum alloy sheet for can ends which has excellent corrosion resistance and age softening resistance and responds particularly to the requirement for forming thinner sheet material for can ends and is suitable for the cover material for aluminum cans to be retort-treated or pasteurized, and a production process thereof.

BACKGROUND OF THE INVENTION

For materials for positive pressure can ends, hard sheets such as Al—Mg 5082 and 5182 alloys containing 4–5% magnesium are commonly used. Although these hard aluminum alloy sheets have excellent strength and formability as well as good corrosion resistance, in light of the demands for cost reduction of the can body itself, there is an increasing demand for a sheet material having a higher strength and formability and yet which can be formed considerably thinner. To respond to these requirements, for example, as described in the Unexamined Patent Publication No. 4-02747, an aluminum alloy in which the magnesium content is raised to between 3.5 and 6.0% and contains copper between 0.05and 0.5% has been proposed.

Al—Mg alloys tend to become work hardened with an increase in magnesium content. In forming the can end, since work hardening occurs on the countersink under light working, high buckling strength can be obtained on the can end subsequent to their manufacture. However, since the loss of strength during storage becomes more marked with an increased magnesium content, even if the buckling strength is within the specific value, there may occur cases where the strength falls below the specific value when the can end is used at canneries.

Further, in the case of cans filled with beverages like coffee or dairy products, retort-treatment is employed. With the lowering of temperature after retort-treatment, the internal pressure in the cans becomes negative. In this case, with respect to the buckling strength required for can ends, even an Al—Mg 5052 alloy is strong enough to be used in 3-piece cans. However, recent technology for simultaneously holding beverages and liquid nitrogen has been established and 2-piece all-aluminum cans have widely been used for non-carbonated beverages like coffee. In this case, since the buckling strength provided by an Al—Mg 5182 alloy will be required, if a conventional Al—Mg 5182 alloy sheet is used as a can end, it has a drawback in that its buckling strength is significantly lowered after retort-treating.

Therefore, to make possible use of thinner can ends for 2-piece all aluminum cans for non-carbonated beverages which must undergo retort-treatment, it is necessary to develop a material having the characteristics of offering a resistance to high pressure similar to that of the Al—Mg 5182 alloy and, at the same time, which does not cause any decrease in buckling strength during storage at room temperature or any decrease in buckling strength after retort-treatment, that is, age softening resistance.

On the other hand, the manufacturing cost reduction of beverage cans has been examined from the standpoint of packaging specifications of the cans. As opposed to conventional methods in which canned drinks are packed in corrugated cardboard boxes, shrink packing, which seals the upper surface of cans with polyvinyl chloride film, has been put to practical use, thus obtaining a reduction in packing costs. In bottling plants, shrink packing is conducted by subjecting cans to air blasting to remove water drops and sealed packing. However, some water drops not removed by air blasting may remain in the score of the can end.

If any water drops remain, the space between the upper surface of the can and the packing film becomes extremely humid and, after packing, if the canned drinks are stored in a warehouse without air-conditioners or placed in shop fronts exposed to the sun, the internal pressure increases. As a result, stress corrosion cracking tends to occur, caused by the increase in tensile stress imposed on the scored rim parts of the cans. It is well known that an increase in magnesium content enhances the tendency toward stress corrosion cracking; as described in the Unexamined Patent Publication No. 2-170940, it has recently been proposed to use an aluminum alloy sheet for packaging with a good corrosion resistance by decreasing the magnesium content to 4% or below and adding small amounts of manganese, copper and chromium as essential alloy components.

However, a decrease in the magnesium content generally causes a drop in the alloy's strength, and it would be hard to achieve satisfactory thinning of the sheet if it had the alloy composition described above. Results of examination by the inventor have shown that fully satisfactory results have not been obtained with respect to prevention of stress corrosion cracking of the scored portion in the case of shrink packing. Although a low magnesium Al—Mg alloy (containing magnesium between 2.8 and 4.2%, manganese between 0.2 and 0.5% and iron between 0.1 and 0.4%) is disclosed in Unexamined Patent Publication No. 5-311308, the mechanical properties of this alloy are not always satisfactory and there is a limit on the thinning of can end stocks.

SUMMARY OF THE INVENTION

As a result of various experiments and examinations of stress corrosion cracking occurring on the scores of the can end when shrink packed with polyvinyl chloride films, the inventors have found that the stress corrosion cracking occurring on Al—Mg alloy results from a phenomenon whereby the electrode potential of a plastically deformed alloy surface stabilizes in a less noble state under a high humidity and aluminum atoms are easily ionized and dissolve in water.

The reason that the electrode potential stabilizes in a less noble state is that the aluminum oxidized film on the uppermost surface of the alloy becomes exposed through plastic deformation and active solute atoms react with water when the metal surface is exposed, thus interrupting the generation of a fine aluminum oxide film. Therefore, to prevent stress corrosion cracking at the score of the shrink-packed can end, it was found necessary to control the solubility limit of the solute atoms.

The inventors also found that as a result of investigations into the correlation between age softening characteristics and internal properties, structures etc. of the Al—Mg alloy, it will be necessary to control the solubility of solute atoms to improve age softening. For that purpose, it will be important to adjust the combination of the alloy compositions and conditions for intermediate heat treatment in the manufacturing process.

This invention was achieved on the basis of the results of the investigations mentioned above, and the purpose of the invention is to offer aluminum alloy sheets which can be used for can ends, have good corrosion resistance, do not cause any stress corrosion cracking under conditions of high temperature and humidity in the shrink packing, and which possesses age softening resistance which maintains a high buckling strength subsequent to the manufacture of the can end, even after retort-treatment and subsequent storage at room temperature. The other purpose of this invention is to offer aluminum alloy sheets which are suitable for use as can ends for non-carbonated beverages and possess excellent corrosion resistance and age softening resistance and yet which can be formed sufficiently thinner, and the manufacturing method of said aluminum alloy sheets.

The primary feature is that the new material for can ends having excellent corrosion resistance and age softening resistance of this invention which achieves the purposes mentioned above consists of aluminum containing magnesium between 3.0 and 4.0%, manganese over 0.5 to 1.0%, copper between 0.2 and 0.6%, and iron between 0.05 and 0.4% and obligatory trace elements. The second feature of this invention is that these aluminum alloy sheets having the chemical composition mentioned above possess an electrical conductivity of 30 to 32% IACS and a yield strength of at least 320 MPa after heating to 260° C.

The third and fourth features are respectively that the new material is a baked aluminum alloy sheet having the chemical composition mentioned above and an electrical conductivity of 30 to 32% IACS and a yield strength of at least 320 MPa, and that said aluminum alloy painted sheet is formed into can ends of 204 size having a panel height of 2.3 mm and when the can end is seamed with a can body and buckling strength is measured by clamping the sealed part from the peripheral side, the proportional drop in buckling strength after heating for 30 minutes at 120° C. as compared to the buckling strength subsequent to forming is less than 10% (provided that in the buckling strength test, the pressure under which the peripheral part of the can end begins to deform shall be assumed to be the buckling strength).

The production process of the aluminum alloy sheet for can ends having excellent corrosion resistance and age softening resistance based on this invention is outlined as follows. After homogenizing an aluminum alloy ingot having the chemical composition mentioned earlier, it is rolled to the specific thickness, submitted to intermediate annealing so that the variation of electrical conductivity (the variation of conductivity=[(Conductivity before heat treatment–Conductivity after heat treatment)/Conductivity before heat treatment] ×100) of the alloy material between before and after the intermediate annealing is limited to 1.0% or more, and thereafter it is finally cold-rolled at a reduction ratio of 70% or more.

DETAILED DESCRIPTION OF THE PREFERRED EMBODIMENTS

Figure 1:
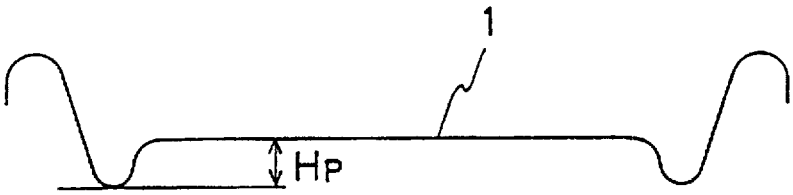
FIG. 1 is a simplified cross sectional view of the can end.

The role and limited scope of the alloy components of the present invention is explained below. Magnesium improves the strength of the sheet and formability when the can end is manufactured. The most desirable content is in a range of 3.0 to 4.0%. If the content is less than 3.0%, it is difficult to obtain a yield strength of at least 320 MPa after baking the sheet and achieving sufficient thinning. If the content exceeds 4.0%, age softening tends to occur, and the ratio of decrease in buckling strength of the can end increases when the can body is retort-treated. There is a possibility that corrosion may occur at the scoring during shrink-packing. A more preferable range of magnesium content is between 3.0 and 3.6%.

Manganese (Mn) suppresses the strength decrease when the alloy sheet is baked. The desirable range of manganese content is over 0.5% and no more than 1.0%. If the content is no more than 0.5%, the suppressing effect is small. If the content exceeds 1.0%, coarse Al—Mn—Fe compounds tend to be produced during casting and the alloy's formability is impaired. If said compounds appear at the scored corner of the can end, micro cracks are caused which become stress concentration because of the notch effect. The stress corrosion cracking tends to occur at the score from shrink packing. A more preferable range of manganese content is between 0.6 and 0.8%.

Copper (Cu) forms Al—Cu—Mg fine compounds when the sheet is baked and contributes to improve the alloy's strength, age softening resistance and corrosion resistance. A desirable range of copper content is 0.2to 0.6%. If the content is less than 0.2%, its effect is small, it is difficult to achieve the can end material thin enough and stress corrosion cracking tends to occur from shrink packing. If the copper content exceeds 0.6%, segregation of Al—Cu and Al—Cu—Mg compounds on the grain boundary becomes noticeable during casting. As it is difficult to fully dissolve these compounds by the usual homogenizing treatment, cracks tend to occur during hot-rolling. A more preferable range of copper content is between 0.25 and 0.45%.

Iron (Fe) is an element which is mixed in as an impurity, and if an aluminum alloy contains the specified amount of iron, it has an improved formability because of a finer structure. A desirable range of iron content is 0.05 to 0.4%, but if the content is less than 0.05%, the cost of raw materials increases because high purity aluminum metal will be necessary. If the content exceeds 0.4%, large Al—Mn—Fe compounds of over 20 μm tend to form during casting and formability and corrosion resistance in shrink packing are lowered. A more preferable range of iron content is between 0.1 and 0.2%.

In this invention, it was found that even if titanium (Ti) in an amount not exceeding 0.1%, boron (B) in an amount of no more than 0.01% and beryllium (Be) (which is added to inhibit the oxidation of Al—Mg alloys) in an amount not exceeding 50 ppm are included, these do not affect the alloy's characteristics. Silicon (Si) which is contained as an obligatory impurity, is permitted to be included in an amount up to 0.4%, and chromium (Cr) and zinc (Zn) respectively, in an amount up to 0.1% each.

In this invention, it was also confirmed that it is necessary for the alloy to have an electrical conductivity of 30 to 32% IACS after heat treatment (for 15 seconds at 260° C.) which corresponds to a baking treatment or after paint baking. The value of the electrical conductivity relates to the solubility of the solute atoms and if the solubility of the solute atoms is high, the electrical conductivity shows a low value. It is important to control the solubility for prevention of stress corrosion cracking at the scoring of the can end from shrink packing. If the electrical conductivity is less than 30% IACS, when the material is plastically deformed under a high humidity, the electrode potential of the surface of the material stabilizes at a less noble value and corrosion tends to occur at the scoring. If the electrical conductivity exceeds 32% IACS, the buckling strength after the filled can is retort-treated will be significantly lowered.

If the yield strength is less than 320 MPa after heat treatment (for 15 seconds at 260° C.) which corresponds to a baking treatment or after paint baking, it is difficult to achieve a satisfactory thinning of the sheet, for example, a thickness of less than 0.25 mm. If the buckling strength of the can end after heating for 30 minutes at 120° C., which corresponds to retort treatment, decreases by 10% or more as compared with that subsequent to forming, there is a possibility that the strength may cause a problem when the can end stocks are made thinner.

Figure 2:
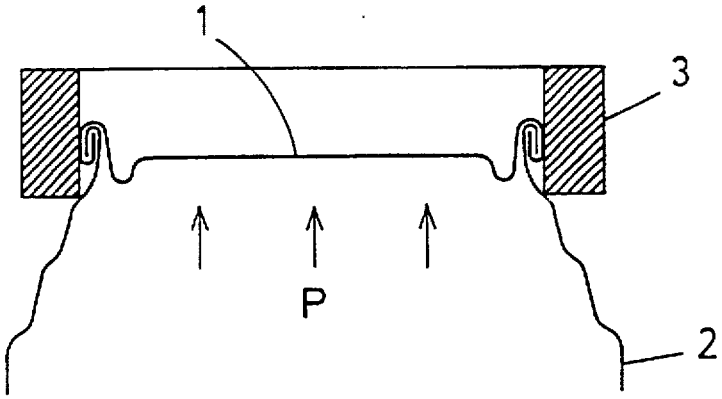
FIG. 2 is a simplified cross sectional view of the buckle strength measuring method of the can end.

In this case, a baked sheet having a thickness of 0.2 to 0.3 mm is formed into a can end (shell(1)) of 204 size (the diameter after seaming is 2.25 inches) and a panel height (Hp) of 2.3 mm using a shell mold as illustrated in FIG. 1 and said shell (1) is sealed with a can body (2). Then the periphery of the sealed part is clamped using a jig (3) and the test for buckling strength is conducted by applying internal pressure (P) as illustrated in FIG. 2. The pressure at which the peripheral part of the can end (periphery of the panel) begins to deform polygonally is measured and is assumed to be the buckling strength.

With respect to the production process of aluminum alloy sheets specified in this invention, intermediate annealing is conducted either after the aluminum alloy is conventionally melted and cast and the ingot is homogenized and subsequently hot-rolled to the specified sheet thickness or after cold-rollinq to the specific sheet thickness after hot-rolling, when necessary. The primary feature of the production process of aluminum alloy sheets in this invention is to control the variation ratio of electrical conductivity (Variation ratio of electrical conductivity=[(Electrical conductivity before heat treatment−Electrical conductivity after heat treatment)/Electrical conductivity before heat treatment]×100) of the sheet between before and after intermediate annealing by 1.0% or more.

In aluminum alloys in this invention, since the second phase compounds precipitate during the hot-rolling and cooling after hot-rolling, it is necessary to redissolve said second phase compounds through intermediate annealing. If the amount of the second phase compounds which are dissolved again are small, it is not possible to control the ratio of decrease in buckling strength after retort-treatment by below 10%. Resolubility and electrical conductivity of the materials show a correlation and in this invention it is important to adjust the state of resolubility so that the variation ratio of electrical conductivity becomes 1% or more.

The second feature in the production process of aluminum alloy sheets is to conduct cold-rolling at a reduction ratio of 70% or more after intermediate annealing. If the reduction ratio is less than 70%, it is not possible to obtain a yield strength of at least 320 MPa after baking, nor to achieve sufficiently thin can end stocks.

A preferable approach would be: aluminum alloys having the composition mentioned above is melted, cast to ingots by semi-continuous casting, and the ingot obtained is homogenized for 4 to 10 hours at 480° to 520° C. Then, it is hot-rolled or both hot-rolled and cold-rolled to the specific thickness, and intermediate annealed. For the intermediate annealing, either a continuous annealing furnace or batch furnace may be applied, and the temperature for the heat treatment, the heating rate and the cooling rate shall be adjusted after the heat treatment so that the variation of electrical conductivity between before and after heat treatment will be 1% or more. However, if the second phase compounds are excessively precipitated again due to heat treatment, the corrosion resistance of the alloy is impaired. Thus, it is necessary to control the heat treatment conditions so that the electrical conductivity of the material after baking or heating at 260° C. remains not less than 30% IACS.

After the intermediate annealing, the aluminum alloy sheet is cold-rolled at the reduction ratio of 70% or more to the thickness of 0.2 to 0.3 mm. Too high a reduction ratio leads to less bendability and high earing, therefore it is preferable to conduct cold-rolling at the reduction ratio in the range of 70 to 90%. For coating of the can end, for example, after pretreatment is conducted with phosphatic chromate, it is coated with epoxy phenol paint and then baked for 1 to 20 minutes at 200° to 270° C. Thereafter, it is formed into the shape as illustrated in FIG. 1 by a shell mold. The typical composition of the aluminum alloy sheet for a can end in this invention is, for example, an aluminum alloy containing 3.3% magnesium, 0.75% manganese, 0.25% copper, 0.25% iron, 0.03% titanium, obligatory trace elements, and 0.10% silicon.

EXAMPLE

The present invention is described in more detail by comparing examples of experimentation and comparative examples.

Example of Experiment 1

An aluminum alloy having the composition as shown in Table 1 was cast into an ingot by semi-continuous casting. After homogenizing for 10 hours at 500° C., the ingot was hot-rolled. The hot-rolling was conducted at a starting temperature of 500° C. and finishing temperature of 290° to 320° C. The sheet thickness after hot-rolling was adjusted in consideration of the reduction ratio. Subsequently, it was cold-rolled at a reduction ratio of 40% and then intermediate annealed.

After intermediate annealing, the aluminum alloy sheet was final cold-rolled to a thickness of 0.25 0.25 mm. The sheet was then treated for 15 seconds at 260° C. using an oil bath as the treatment corresponding to baking treatment after coating, and the electrical conductivity and mechanical properties after the heat treatment were measured. Conditions for the intermediate annealing, the variation ratio of electrical conductivity before and after the intermediate annealing, and the reduction ratio of the final cold-rolling are shown in Table 2.

The sheet after baking was formed into a can end of 204 size (panel height: 2.3 mm) as illustrated in FIG. 1, and buckling strengths both immediately after producing the can end and after heating for 30 minutes at 120° C. corresponding to retort-treatment were measured. The value as a percentage (the proportional drop in buckle strength) was obtained from the variation between both buckling strengths divided by the buckling strength immediately after producing the can end. The electrical conductivity, tensile properties, and proportional drop in buckling strength after the sheet material was coated and baked are shown in Table 3.

To evaluate the stress corrosion cracking, a scored groove was formed perpendicular to the rolling direction on a test piece of the sheet (width of the sheet: 10 mm), a mist spray of water solution containing 100 ppm NaCl(pH=6) applied near the score and, immediately after the mist spraying, it was packed with a polyethylene wrapping sheet which was used for preservation of foods to prevent evaporation of water droplets attached to the test piece. The test piece was attached to a fatigue evaluation device (Servo-pulse, Shimadzu Corporation), a tensile load equivalent to 80% (sinewave: frequency=0.01 Hz) of the standard rupture load of the scored test piece which was previously measured was applied. A stress applied frequency was obtained until the test piece ruptured at room temperature (approximately 25° C.). This test method simulates the tensile stress for the applied stress to the scoring caused by a rise in internal pressure which occurs in actual beverage cans. The results of the evaluation of stress corrosion cracking are shown in Table 3.

As shown in Table 3, it is found that each test piece prepared according to this invention possesses a yield strength of at least 320 MPa after a treatment equivalent to baking and a ratio of decrease in buckling strength of less than 10 percent and maintains a high buckling strength equivalent to that obtained immediately after producing the can ends even after retort-treatment. In the evaluation of the stress corrosion cracking by the fatigue testing device, excellent stress corrosion cracking which can ensure repeated stresses of 3,000 cycles was demonstrated.

TABLE 1

| Test piece | Composition (wt %) Mg | Mn | Cu | Fe | Remarks |
|---|---|---|---|---|---|
| A | 3.5 | 0.80 | 0.40 | 0.30 | |
| B | 3.2 | 1.00 | 0.20 | 0.10 | |
| C | 3.9 | 0.60 | 0.20 | 0.35 | |
| D | 2.8 | 0.90 | 0.30 | 0.30 | |
| E | 3.2 | 0.35 | 0.12 | 0.30 | |
| F | 4.5 | 0.50 | 0.20 | 0.30 | |
| G | 3.9 | 0.60 | 0.90 | 0.30 | |
| H | 3.5 | 1.50 | 0.20 | 0.65 | |
| I | 4.5 | 0.40 | 0.05 | 0.30 | 5182 alloy |

TABLE 2

| Test piece No. | Alloy No. | Conditions for intermediate annealing: Heating rate (°C./s) | Holding (°C. × Time) | Cooling rate (°C./s) | Variation ratio of electrical conductivity (%) | Final Cold-rolling reduction (%) |
|---|---|---|---|---|---|---|
| 1 | A | 30 | 520 × 5 s | 30 | 3.1 | 80 |
| 2 | A | 30 | 450 × 30 s | 30 | 1.5 | 80 |
| 3 | A | 50° C./h | 400 × 1 h | WQ | 1.2 | 80 |
| 4 | B | 30 | 490 × 10 s | 30 | 2.0 | 70 |
| 5 | B | 30 | 550 × 5 s | 30 | 2.3 | 80 |
| 6 | C | 30 | 500 × 5 s | 30 | 3.0 | 80 |
| 7 | C | 50° C./h | 390 × 1 h | WQ | 2.7 | 80 |
| 8 | C | 30 | 500 × 5 s | 30 | 3.0 | 70 |

(Note) Cooling rate WQ: Water quench

TABLE 3

| Test piece No. | Electrical Conductivity (% IACS) | Tensile properties: Yield strength (MPa) | Tensile strength (MPa) | Elongation (%) | [Buckle] Buckling strength [dropping] reduction rate (%) | Stress corrosion cracking (frequency until rupture) |
|---|---|---|---|---|---|---|
| 1 | 31.2 | 335 | 372 | 7 | 7.2 | >3000 |
| 2 | 31.6 | 328 | 370 | 7 | 7.4 | >3000 |
| 3 | 31.6 | 322 | 370 | 7 | 7.5 | >3000 |
| 4 | 31.5 | 323 | 366 | 7 | 7.1 | >3000 |

TABLE 3-continued

| Test piece No. | Electrical Conductivity (% IACS) | Tensile properties: Yield strength (MPa) | Tensile strength (MPa) | Elongation (%) | [Buckle] Buckling strength [dropping] reduction rate (%) | Stress corrosion cracking (frequency until rupture) |
|---|---|---|---|---|---|---|
| 5 | 31.3 | 325 | 368 | 7 | 7.2 | >3000 |
| 6 | 30.5 | 338 | 377 | 7 | 8.1 | >3000 |
| 7 | 30.9 | 330 | 375 | 7 | 8.5 | >3000 |
| 8 | 30.6 | 328 | 370 | 8 | 8.1 | >3000 |

Comparative Example 1

Similar to the Example of Experiment 1, an aluminum alloy having the composition shown in Table 1 was cast into an ingot by semi-continuous casting. The ingot obtained was homogenized, hot-rolled and cold-rolled under the same conditions as the Example of Experiment 1, then finally cold-rolled after intermediate annealing under various conditions. The conditions for the intermediate annealing, variation ratio of electrical conductivity before and after the intermediate annealing and final cold-rolling reduction are shown in Table 4.

With respect to the test pieces of aluminum alloy sheet after final cold-rolling, upon applying treatment equivalent to the same baking as that of the Example of Experiment 1, the electrical conductivity and tensile properties were measured and the ratio of decrease in buckling strength was obtained by the same method as that of the Example of Experiment 1. The stress corrosion cracking was then evaluated. These measurements and the results of the evaluations are shown in Table 5.

TABLE 4

| Test piece No. | Alloy No. | Conditions for intermediate annealing: Heating rate (°C./s) | Holding (°C. × Time) | Cooling rate (°C./s) | Variation ratio of conductivity (%) | Final Cold-rolling reduction (%) |
|---|---|---|---|---|---|---|
| 9 | B | 30 | 400 × 5 s | 30 | 0.8 | 70 |
| 10 | A | 50° C./h | 400 × 1 h | 50° C./h | 0.8 | 80 |
| 11 | A | 30 | 520 × 5 s | 30 | 3.1 | 60 |
| 12 | C | 30 | 550 × 5 min | 30 | 3.7 | 80 |
| 13 | D | 30 | 500 × 5 s | 30 | 1.9 | 80 |
| 14 | E | 30 | 500 × 5 s | 30 | 1.8 | 80 |
| 15 | F | 30 | 500 × 5 s | 30 | 3.3 | 80 |
| 16 | G | — | — | — | — | — |
| 17 | H | 30 | 500 × 5 s | 30 | 2.8 | 80 |
| 18 | I | 30 | 450 × 5 s | 30 | 2.6 | 80 |

TABLE 5

| Test piece No. | Electrical Conductivity (% IACS) | Tensile properties: Yield strength (MPa) | Tensile strength (MPa) | Elongation (%) | [Buckle] Buckling strength [dropping] reduction rate (%) | Stress corrosion cracking (frequency until rupture) |
|---|---|---|---|---|---|---|
| 9 | 31.8 | 308 | 357 | 7 | 12.2 | >3000 |
| 10 | 32.2 | 310 | 367 | 8 | 11.0 | >3000 |

TABLE 5-continued

| Test piece No. | Electrical Conductivity (% IACS) | Tensile properties Yield strength (MPa) | Tensile strength (MPa) | Elongation (%) | [Buckle] Buckling strength [dropping] reduction rate (%) | Stress corrosion cracking (frequency until rupture) |
|---|---|---|---|---|---|---|
| 11 | 31.3 | 310 | 364 | 8 | 7.6 | >3000 |
| 12 | 28.7 | 340 | 380 | 7 | 7.7 | 1530 |
| 13 | 31.5 | 315 | 365 | 7 | 7.1 | >3000 |
| 14 | 31.5 | 314 | 366 | 7 | 7.3 | >3000 |
| 15 | 29.3 | 333 | 380 | 8 | 13.4 | 1300 |
| 16 | — | — | — | — | — | — |
| 17 | 30.9 | 327 | 368 | 8 | 7.8 | 1680 |
| 18 | 29.0 | 315 | 382 | 8 | 13.8 | 1440 |

As can be seen in Table 5, for Test Piece No. 9, the ratio of the decrease in buckling strength increases because the variation in the ratio of electrical conductivity before and after intermediate annealing falls to below 1% due to unsuitable intermediate annealing conditions. For Test Piece No. 10, the ratio of decrease in buckling strength increases because the variation ratio of electrical conductivity before and after intermediate annealing falls to below 1% due to unsuitable intermediate annealing conditions, and the conductivity of the final sheet is too high. For Test Piece No. 11, the tensile strength and yield strength are low because the final cold-rolling reduction is small. For Test Piece No. 12, the corrosion resistance is inferior because the electrical conductivity is decreased due to the excessive amount of solution of the solute atoms caused by the intermediate annealing. For Test Piece No. 13, the yield strength is inferior because of the low magnesium content.

For Test Piece No. 14, the yield strength is low because of low manganese and copper content. For Test Piece No. 15, the corrosion resistance is inferior because of low electrical conductivity due to excess amounts of magnesium and the ratio of decrease in buckling strength increases. For Test Piece No. 16, the test piece itself was not available because cracking occurred during hot-rolling due to an excess quantity of copper. For Test Piece No. 17, the stress corrosion cracking property is inferior because large Al—Mn—Fe compounds are produced due to the excess content of manganese and iron, and fine cracks occurred on the score when making scores. For Test Piece No. 18 which is a conventional Al—Mg 5182 alloy sheet, the yield strength is low, the ratio of decrease in buckling strength is large, and the corrosion resistance is inferior due to low electrical conductivity because it has a high content of magnesium, and low contents of manganese and copper.

As explained above, this invention offers an aluminum alloy sheet for can ends which has a good corrosion resistance, is free from the occurrence of stress corrosion cracking, even under the high humidity conditions inside shrink packing, and good age softening resistance, maintaining a high buckling strength even after being retained at room temperature after producing the can end or after subsequent retort-treatment. These aluminum alloy sheets will be particularly suitable for can ends for non-carbonated beverages, and it will be possible to form the aluminum sheets sufficiently thin.

We claim:

1. An aluminum alloy sheet having excellent corrosion and age softening resistance, said aluminum alloy comprising from 3.0–3.6 wt. % Mg, more than 0.5 to not more than 1.0 wt. % Mn, 0.2–0.6 wt. % Cu, 0.05–0.4 wt. % Fe and the balance being aluminum and having an electrical conductivity of 30–32% IACS after heating at 260° C. and a yield strength of at least 320 MPa.

2. A coated aluminum alloy sheet having excellent corrosion and age softening resistance, said sheet being made up of an aluminum alloy comprising from 3.0–3.6 wt. % Mg, more than 0.5 to not more than 1.0 wt. % Mn, 0.2–0.6 wt. % Cu, 0.05–0.4 wt. % Fe and the balance being aluminum and having an electrical conductivity of 30–32% IACS after heating at 260° C., a yield strength of at least 320 MPa and an organic coating provided thereon.

3. A coated aluminum alloy sheet having excellent corrosion and age softening resistance, said aluminum alloy comprising from 3.0–3.6 wt. % Mg, more than 0.5 to not more than 1.0 wt. % Mn, 0.20.6 wt. % Cu, 0.05–0.4 wt. % Fe and the balance being aluminum and having an electrical conductivity of 30–32% IACS after heating at 260° C. and a yield strength of at least 320 MPa.

4. A coated aluminum alloy can end having excellent corrosion and age softening resistance, said can end being of size 204 and having a panel height of 2.3 mm, said can end being made from a sheet of an aluminum alloy coated with an organic resin, said aluminum alloy comprising from 3.0–3.6 wt. % Mg, more than 0.5 to not more than 1.0 wt. % Mn, 0.2–0.6 wt. % Cu, 0.05–0.4 wt. % Fe and the balance being aluminum and having an electrical conductivity of 30–32% IACS after heating at 260° C. and a yield strength of at least 320 MPa, the ratio of decrease in buckling strength of the can end being less than 10% after heating for 30 minutes at 120° C. the buckling strength being determined by seaming the can end with a can body, clamping the seamed portion of the can end and applying an internal pressure until the periphery of the can end begins to deform polygonally.

* * * * *

UNITED STATES PATENT AND TRADEMARK OFFICE

CERTIFICATE OF CORRECTION

PATENT NO. : 5 746 847

DATED : May 5, 1998

INVENTOR(S) : Hiroki TANAKA et al

It is certified that error appears in the above-indentified patent and that said Letters Patent is hereby corrected as shown below:

Column 10, line 31; change "0.20.6 wt.% Cu" to
---0.2-0.6 wt.% Cu---.

Column 10, line 46; change "at 120°C. the buckling strength" to
---at 120°C, the buckling strength---.

Signed and Sealed this

Twenty-fifth Day of August, 1998

Bruce Lehman

*Attest:*

BRUCE LEHMAN

*Attesting Officer*

*Commissioner of Patents and Trademarks*